United States Patent [19]

Rottler et al.

[11] Patent Number: 4,541,620

[45] Date of Patent: Sep. 17, 1985

[54] SLED FOR FIXTURING ENGINE BLOCKS

[75] Inventors: Donald B. Rottler; David Engnell, both of King County, Wash.

[73] Assignee: Rottler Manufacturing, Inc., Kent, Wash.

[21] Appl. No.: 502,974

[22] Filed: Jun. 10, 1983

[51] Int. Cl.[4] ..... B25B 1/24

[52] U.S. Cl. ..... 269/46; 269/47; 269/71; 269/902

[58] Field of Search ..... 33/174 TC, 174 S, 174 M; 248/645, 646, 671; 294/78 A, 78 R, 81 R; 269/20, 71, 47, 52, 46, 902, 900, 88

[56] References Cited

U.S. PATENT DOCUMENTS

| | | | |
|---|---|---|---|
| 3,343,861 | 9/1967 | Sinicki | 294/81 R |
| 4,022,453 | 5/1977 | Durgan | 269/71 |
| 4,298,307 | 11/1981 | Bergman | 269/20 |

FOREIGN PATENT DOCUMENTS

| | | | |
|---|---|---|---|
| 716968 | 2/1980 | U.S.S.R. | 269/71 |

*Primary Examiner*—Robert C. Watson

*Attorney, Agent, or Firm*—Seed and Berry

[57] ABSTRACT

An improved sled for fixturing engine blocks includes an inclined mounting surface which can be supported at alternate inclinations for fixturing engine blocks having various V-angles. A preferred embodiment utilizes a two-way frame which is removably mounted on the sled for supporting various V-blocks with the main bearing cap in place. Air float means are also preferably provided for lifting the sled above a supporting surface to facilitate maneuvering the sled. One preferred embodiment includes a novel means of aligning and securing an engine block on the sleds which includes a sling for rotatably engaging and lifting a block.

14 Claims, 12 Drawing Figures

FIG. 3
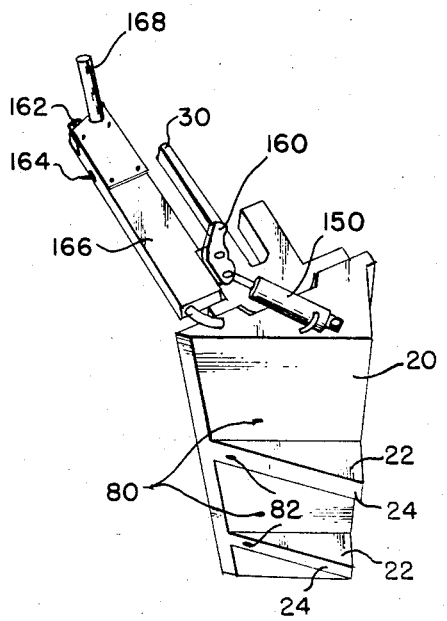
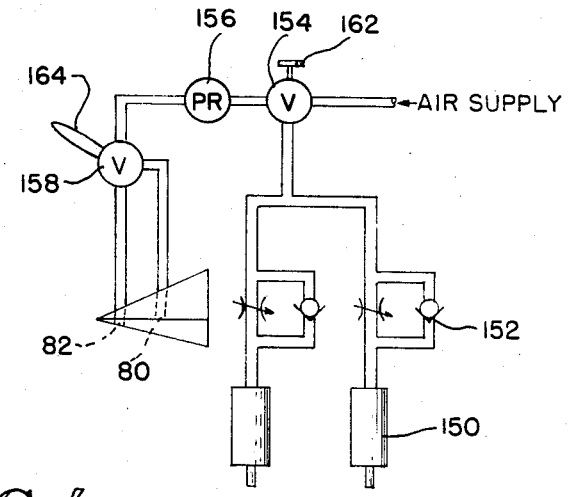
FIG. 4

SLED FOR FIXTURING ENGINE BLOCKS

DESCRIPTION

TECHNICAL FIELD

This invention relates to devices for fixturing engine blocks, and more particularly, to a sled assembly for fixturing Y- and V-shaped engine blocks.

BACKGROUND ART

Certain engine blocks, such as V-blocks or Y-blocks, include a number of cylindrical bores on each side of the block which extend into a block at a common angle inclined from the vertical axis. For a given block, the central axes of the bores of one side will intersect with the central axes of the bores of the other side to form an angle, referred to herein as the "V angle." The V angle will represents twice the value of the inclination of each bank of cylinders from the vertical axis.

One common type of machine for reboring the cylinders of an engine block employs a boring tool which is rotatably mounted on a vertically disposed shaft. The boring tool is lowered along a vertical pathway into a cylinder to rebore the cylinder. It is thus necessary for proper reboring that the cylinder be aligned under the boring tool and oriented such that its central axis is vertical.

Boring machines designed for use with engine blocks having a plurality of cylinders aligned in a row, referred to hereinafter as a "bank" of cylinders, are commonly mounted on a planar slide surface. Such an arrangement enables the machine to be slid over each successive cylinder in a bank, thereby allowing all the cylinders in a given bank to be rebored while the block is fixtured in a single position. Sliding of the machine along the planar slide surface is normally restricted to a straight-line pathway so that if the first cylinder in a bank is properly aligned with the machine and fixtured in place, the remaining cylinders will also be properly aligned.

In order to properly align a V-block or Y-block so that an entire bank of cylinders can be rebored from a single fixtured position, it is necessary to incline the block so that the cylindrical bores are in a vertical position. The block must then be vertically and horizontally aligned or "indexed" with respect to the planar slide surface so that the boring tool can be lowered into each cylinder with its central axis positioned substantially in the same position as the central axis of the cylinder.

One known method of aligning and fixturing a V-block or Y-block is to mount the block on a mounting fixture known as a "sled." A conventional sled comprises a triangular solid having cross-sections forming right triangles and a planar mounting surface formed by the hypotenuse of the triangular cross-sections. The mounting surface is inclined from the horizontal at an angle which is equal to half the V-angle of the block, so that when the bottom of a block is mounted on the sled and properly aligned on the mounting surface, one bank of cylinders will be in a vertical position, as required for reboring. (When referring to the "bottom" of an engine block herein, it is of course understood that the pan rail which forms the bottom of the block is often irregularly shaped. The main bearing caps, for example, will project downwardly from the block when in place. The lower portion of a block will, however, generally form a plane which is referred to herein as the bottom of the block.)

An example of a conventional sled is illustrated in FIG. 8. The sled includes a securing bar which is adjustably positioned parallel to and spaced apart from the planar mounting surface to harness a block between the planar mounting surface and the securing bar. Bracket assemblies positioned on each end of the planar mounting surface support a pair of threaded column members which extend outwardly from the planar mounting surface through the securing bar. Wing nuts fit on the projecting ends of the column members to allow the securing bar to be tightened down to secure a block to the sled. Proper alignment of the block on the sled is ensuring by an alignment bar which is inserted through the main bearing housing of the block and fixtured within openings in the bracket assemblies to align the block with respect to the sled.

In a conventional arrangement, an engine block is placed on the mounting surface, properly aligned using the alignment bar, and secured in place by tightening the securing bar down. The sled and engine block may then be moved as a unit using a hoist or the like and placed on the base assembly of a boring machine beneath the boring tool. The base assemblies normally include a pair of slide surfaces on which the sled may be placed for proper adjustment and alignment with respect to the boring machine. Some machines utilize base assemblies having a spindle on which a sled may be placed for easy rotation and adjustment.

Conventional sleds enable engine blocks to be mounted on a sled with or without the main bearing caps of the block in place. When the main bearing cap of a V-block is in place, it is necessary to use an elevating frame on the mounting surface to support the bottom portions of the block on either side of the main bearing cap. The frame is necessary because the main bearing cap projects outwardly beyond the bottom of the block. Without some means of supporting the outer portions of the bottom of an engine block, the block would tilt out of alignment with the mounting surface and the cylinders would no longer be in a vertical position.

Although existing sleds provide a means for fixturing V- and Y-blocks, several disadvantages remain with existing models. One disadvantage is that a separate sled is required for blocks having different V-angles. For example, a sled designed for a 60° V-angle block cannot be used with a 90° V-angle block. Another disadvantage is that the fixturing process is relatively slow. In many arrangments, it is necessary to fixture a block twice on the sled in order to rebore both banks of cylinders. Thus, the time required for fixturing a block on the sled becomes a very important factor in the overall efficiency of the sled. It is desirable to provide an arrangement which facilitates relatively quick fixturing to minimize the time expended here. Another disadvantage of existing sleds is that they can often be bulky and difficult to handle. It is desirable to provide a sled which will be easy to maneuver by the operator and include safety features to reduce the chance of accidentally dropping the sled on the operator.

DISCLOSURE OF INVENTION

It is an object of this invention to provide a fixturing device for use with V-blocks and Y-blocks which can be used with blocks having varying V-angles.

It is another object of this invention to provide such a device which can be safely and easily operated.

It is another object of this invention to provide a fixturing device for use with V-blocks and Y-blocks which will enable the blocks to be quickly and easily fixtured on the device.

It is another object of this invention to provide a fixturing device which is adaptable for use with engine blocks having the main bearing caps on or off.

It is another object of this invention to provide such a device which provides a means for fixturing blocks of varying shapes with the main bearing caps off.

It is another object of this invention to allow V-blocks and Y-blocks to be readily shifted from a position for reboring one bank of cylinders to a position for reboring a second bank of cylinders.

These and other objects, which will become more apparent as the invention is more fully described below, are obtained by providing an improved sled assembly for fixturing V-blocks and Y-blocks of varying shapes and angles. In a preferred embodiment, a pair of wedge-shaped extensions depend from the bottom side of the sled to provide an alternate slide/support surface for the sled. Preferred embodiments are designed to be used with base assemblies having spaced-apart slide surfaces such that the sled may be placed on the slide surfaces with either the wedge-shaped extensions or the sled bottom engaging the spaced-apart slide surfaces of the base assembly, thereby allowing the mounting surface of the sled to be inclined at alternate angles for use with engine blocks having varying V-angles.

One preferred embodiment includes air float means operable to provide an air cushion between either the bottom side of the sled or the wedge-shaped extensions and the slide surfaces of the base assembly to facilitate sliding the sled in either of the alternate positions.

A special alignment assembly utilized in one preferred embodiment uses an alignment bar which is inserted through the main bearing housing and lowered into an alignment slot on the sled to index the bottom and side of the main bearing housing of the block with respect to the sled as the block is lowered onto the mounting surface of the sled. The alignment rod is specially shaped to provide indexing points. Special spacer blocks are installed into the bottom of the alignment slot to support lower indexing points when a block having the main bering cap removed is to be rebored.

A specially designed sling is provided for engaging a block and lowering it into the alignment slot after the alignment rod has been inserted into the block. The sling rotatably engages a block in the cam openings such that the block can rotate into the desired position as the bar is lowered along the slot.

A two-way frame for elevating V-shaped blocks of various shapes is provided.

A second preferred embodiment utilizes a modification of a conventional alignment means. Reversible blocks are provided to maximize the potential number of arrangements for securing the conventional alignment bar within the brackets.

BRIEF DESCRIPTION OF THE DRAWINGS

FIG. 3 is an isometric view illustrating the bottom of the sled of FIG. 2.

FIG. 4 is a schematic view illustrating the pneumatic air float and locking finger system of the sled of FIGS. 2 and 3.

FIG. 9A is a side elevation view illustrating the position of the alignment bar within the main bearing housing for an engine block fixtured on the sled of FIGS. 2 and 3 with the main bearing cap on.

BEST MODE FOR CARRYING OUT THE INVENTION

Figure 1:
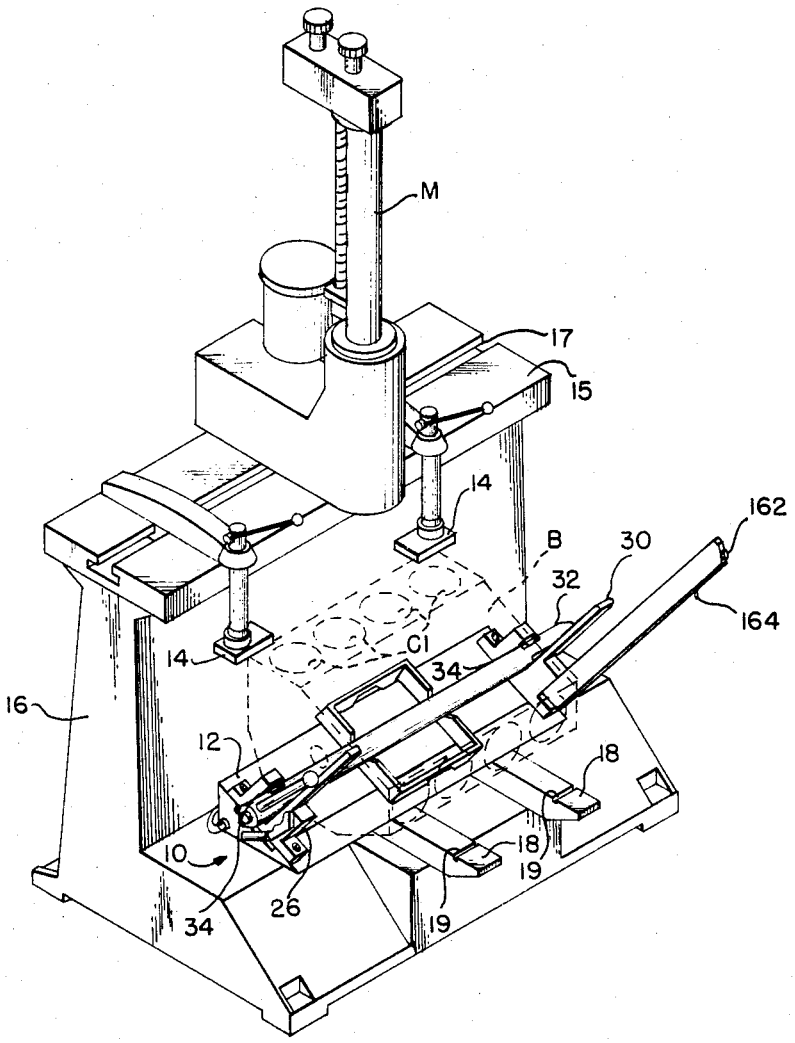
FIG. 1 is an isometric view of the first preferred embodiment of the invention illustrating an engine block (in phantom) aligned and fixtured beneath a boring machine.

A preferred embodiment of the invention is illustrated in FIG. 1. An engine block B (shown in phantom) is fixtured beneath a boring machine M with a first bank of cylinders $C_1$ aligned with respect to the boring machine. The boring machine is mounted on the planar slide surface 15 of a base assembly 16. The slide surface includes an elongated slot 17 which restricts the movement of the machine along the slide surface to a straight line pathway. The boring machine can be adjusted forwardly or rearwardly on the slide surface a relatively small distance to fascilitate alignment of the boring tool over the cylinder bank.

The engine block is mounted on a fixturing sled 10 with its bottom side on the mounting surface 12 of the fixturing sled. The mounting surface is inclined so as to tilt the block so that the first bank of cylinders is in a vertical position. The portion of the block adjacent the first bank of cylinders is held in place by a pair of adjustable clamping blocks 14 which depend from the base assembly 16 on which the boring machine is mounted. The bottom surface of the sled is supported by a pair of spaced-apart lower slide surfaces 18 which are mounted on the bottom of the base 16 such that they project forward of the boring machine. The sled has been aligned with respect to the base assembly such that the first bank of cylinders is aligned with the straight line pathway of the machines along the slide surface.

As best seen in FIG. 3, the sled bottom 20 includes a pair of spaced-apart, wedge-shaped extensions 22 which depend therefrom to form a pair of alternate support surfaces 24. The extensions enable the sled to be supported on the lower slide surfaces 18 by either the sled bottom or the extensions. Thus, two alternate inclinations of the mounting surface 12 are provided to enable the sled to be used with engine blocks having various V-angles.

Figure 2:
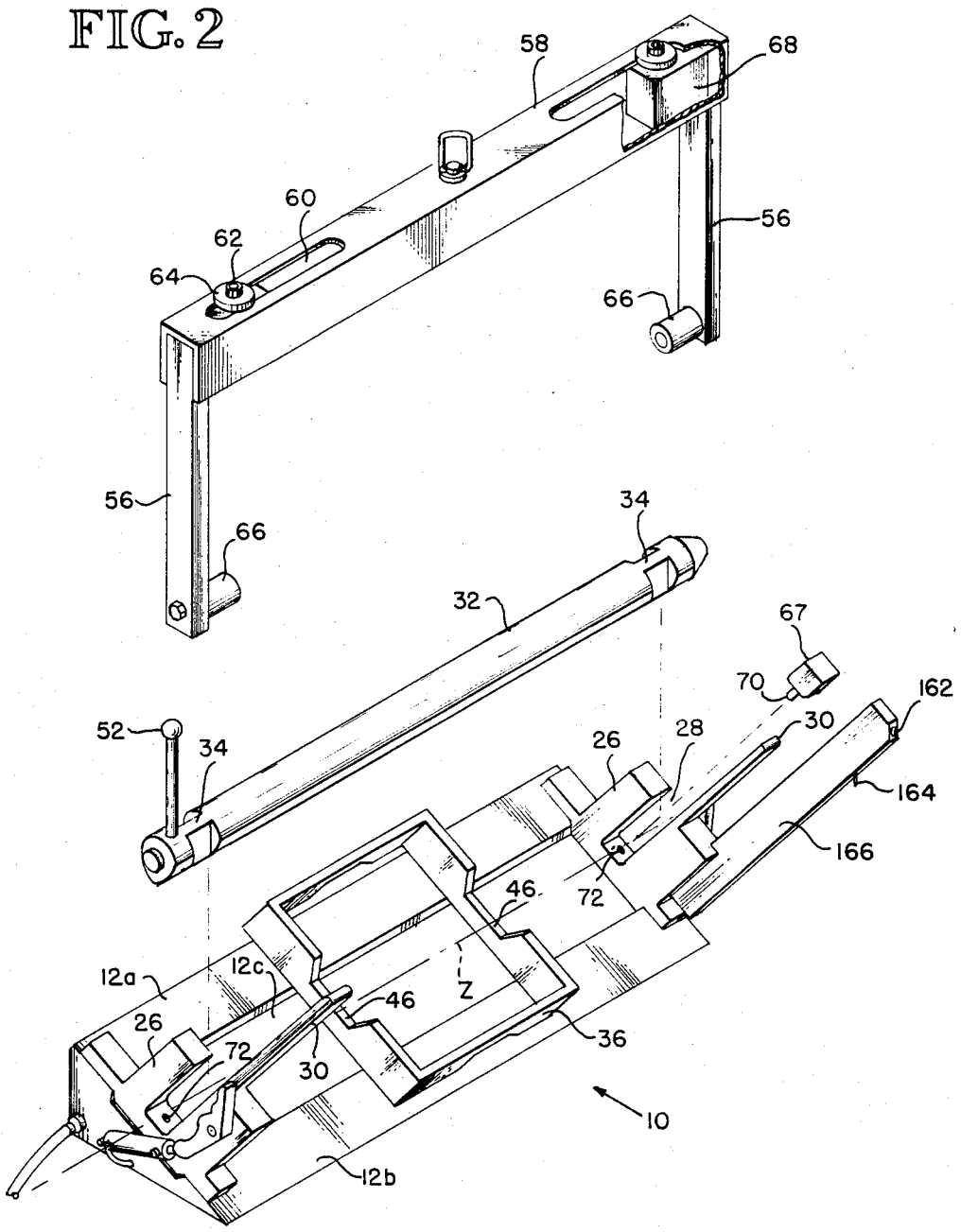
FIG. 2 is an exploded isometric view of a first preferred embodiment of the invention.

A preferred embodiment of the invention illustrated in FIGS. 1–3 utilizes a novel means for aligning an engine block on the sled. To properly align an engine block with respect to the sled, it is necessary to do two things. First, the bottom of the engine block must be held in a plane which is parallel to the inclined mounting surface. Second, a longitudinal axis of the block (for example, the central axis of the main bearing housing) must be aligned above an axis which extends longitudinally through the center of the mounting surface (see axis Z in FIG. 2). When these two alignments are made using a block having a V-angle corresponding to the inclination of the mounting surface, one bank of cylinders will be aligned such that the central axis of each cylinder is vertical and the intersection points of the central axes of the cylinders with the mounting surface will define a line which is parallel to axis Z.

As illustrated in FIG. 2, the mounting surface 12 is formed by the top surfaces of a pair of elongated plates 12*a*, 12*b* which extend longitudinally across the sled. The plates define a central trench 12*c* therebetween. The top surfaces of the plate are coplanar and inclined with respect to the bottom of the sled 20 and with respect to the alternate support surfaces 24 at predetermined angles which correspond to the V-angles of blocks to be fixtured by the sled. For a sled for use with typical V-blocks, these angles would be 30° and 45°, respectively.

A bracket 26 projects outwardly from each end of the trench at an angle perpendicular to the mounting surface. The brackets include an alignment slot 28 formed therein and a handle 30 which extends outwardly therefrom. An alignment rod 32 includes cutaway portions 34 near each end of the rod which are sized and spaced to fit within the alignment slots. The central portion of the rod (between the cutaway portions) is designed to fit within the main bearing housing of an engine block. As best seen in FIGS. 9A-B and 10A-B, the cross-section of the alignment rod includes a semicircular upper portion and a pair of inwardly declining lower sides which intersect at a flat bottom portion. The upper portion fits within the top half of the main bearing housing. The intersection between the top portion and one side forms an indexing point as does the flat bottom portion. As described in detail below, the cutaway portions of the rod are fixtured at a common elevation within the alignment slots and the block rests on the rod at correspondingly positioned index points to ensure that a block is aligned properly.

Figure 9A:
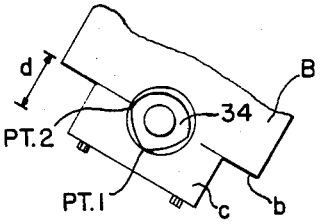

When a V-block having its main bearing cap in place is to be fixtured on the sled, it is necessary to use a frame 36 to support the bottom of the block. As illustrated in FIG. 9A, the main bearing cap C of such a block depends from the bottom b of the block B a distance d. As the distance d is generally larger than the depth of the trench 12*c*, it is desirable for stability and safety to provide means for supporting the bottom of the block on each side of the main bearing cap. Additionally, without such a support means, V-blocks would rest on the sled at a location lower than other blocks. As the alignment slots slope downwardly and rearwardly, this reduced elevation would leave such blocks resting further back on the sled than Y-blocks, for example. This result is undesirable as it is preferred that the cylindricals bores of the various block type be fixtured in as nearly the same location (front-to-rear) on the sled as possible, thereby minimizing the front-to-rear adjustment of the boring tool necessary to align the boring tool with the cylindrical bores.

Figure 5:
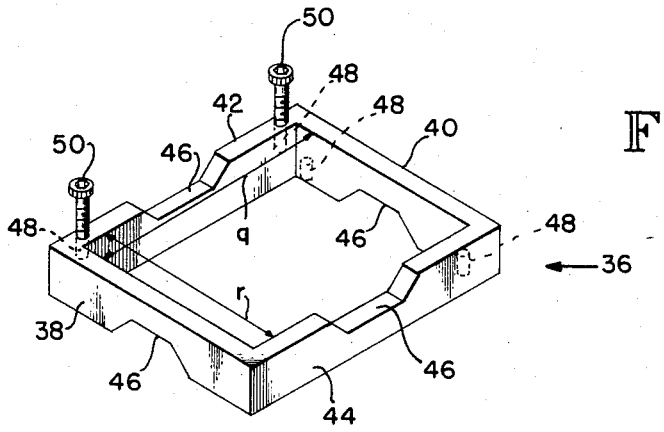
FIG. 5 is an isometric view of the improved elevating frame of this invention.
Figure 7:
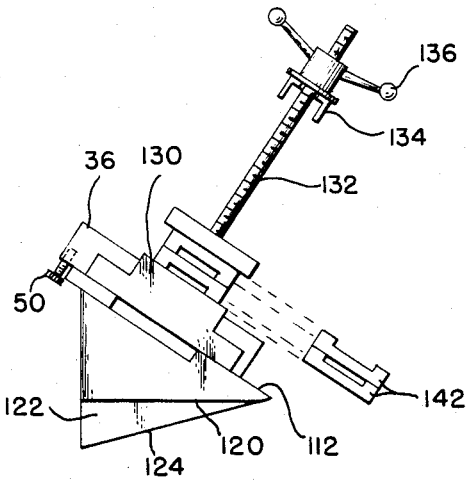
FIG. 7 is a side elevation view of the second preferred embodiment of the invention illustrating the reversible C-shaped blocks.
Figure 8:
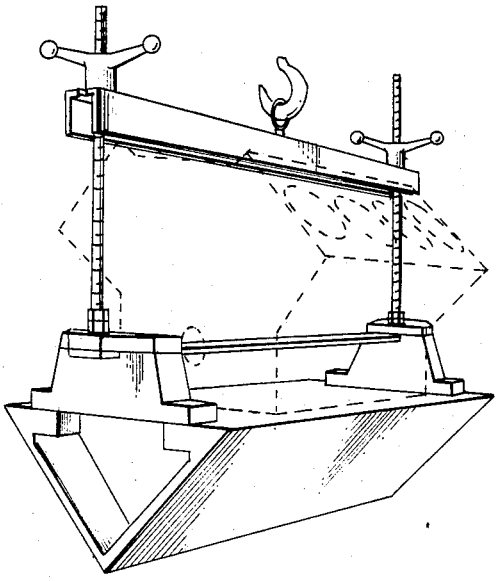
PRIOR ART FIG. 8
FIG. 8 is an illustration of a conventional prior art sled.

It is preferred that the improved frame 36 illustrated herein be utilized as such support means. As best illustrated in FIG. 5, the frame comprises a first pair of opposed side members 38, 40 which are spaced apart a distance q and a second pair of opposed spaced-apart side members 42, 44 which are spaced apart a distance r, where $r<q$. A central portion of the bottom of each of the first pair of sides includes a recess 46 to allow passage of the alignment rod while the engine block is supported by the bottoms of the side members. Similarly, the central portion of the top of each of the second pair of side members includes a recess 46 to allow passage of the alignment rod when the bottom of the block is resting on the top of the sides 42, 44. The side members are configured such that the support surfaces formed on either side of the recesses will be substantially parallel to the mounting surface when the frame is mounted on the mounting surface. As seen in FIG. 5, two adjacent side members 40, 42 each include a pair of threaded apertures 48 on opposite ends of their bottom and top sides, respectively, for receiving bolts 50. The bolts extend outwardly from the sides to overhang the top of the mounting surface of the sled, as illustrated in FIG. 7, to prevent the frame from sliding off the mounting surface.

The frame 36, illustrated in FIG. 5, is set up for the first pair of side members to support the bottom of an engine block. For certain types of blocks, however, this setup may not be workable. The main bearing caps may project from the bottom of the block at locations which prohibit the block from being supported by side members which are spaced a distance q apart. In these instances, the improved frame 36 may be modified by moving the bolts 50 into the threaded apertures 48 in the adjacent side member, thereby providing a frame having two side members spaced apart a lesser distance r for supporting the bottom of the engine block.

When fixturing a block having its main bearing cap in place, alignment is accomplished as follows: If the block is a V-block, a frame 36 is placed on the mounting surface as shown in FIG. 2. The alignment rod is then inserted through the main bearing housing on the block. A handle 52 projects outwardly from the top of the rod to facilitate maneuvering the rod inside the main bearing housing.

When the alignment rod is in place, the block is raised over the sled using a specially designed sling 54 attached to a conventional hoist means (not shown). The sling includes a pair of sling arms 56 which depend from an enongated channel 58. The channel includes elongated slots 60 which extend inwardly from near each end of the channel. A pair of tension locking bolts 62 are held above respective slots by washers 64. The bolts extend downwardly from the top of the channel to engage and support a sling arm. Near the bottom of each sling arm, a cam ear 66 extends inwardly. The cam ears are sized to fit within the cam shaft opening of an engine block.

To raise a block using the sling, the sling is lowered over the block and the sling arms adjusted such that the cam ears extend into the cam opening of the block. The sling arms are preferably positioned symmetrically on the channel. The sling is then raised causing the bolts to tighten and secure the sling arms in place. The sling arms preferably include a mounting web 68 which extends inwardly from the top of the sling arm to receive the bolt as illustrated in FIG. 2. This arrangement enables the bolt to be positioned substantially over the weight-bearing portion of the cam ear.

When mounting a block on the sling, it is raised over the sled and lowered into place such that the cutaway portions 34 of the alignment rod are aligned directly over the alignment slots 28. The block is then further lowered such that the cutaway portions of the alignment rod enter the alignment slots. At this point, the block begins to rotate about the cam ears as it is lowered into an inclined position such that the cylinders of one bank are in vertical position.

Figure 9B:
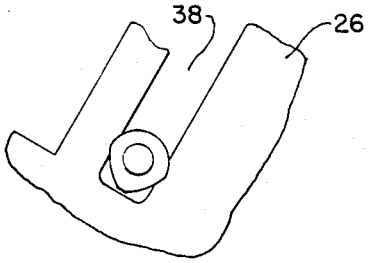
FIG. 9B is a side elevation view illustrating the position of the alignment bar within the alignment slot for the arrangement of FIG. 9A.

When the block being fixtured has its main bearing caps in place, the block and alignment rod will come to rest in the position illustrated in FIGS. 9A and 9B. For a V-block, as shown in FIG. 9A, the bottom b of the block will be supported by the frame 36. The alignment rod will contact the main bearing housing at two indexing points along the length of the housing: Point 1 (designated PT. 1) at the bottom of the housing and Point 2 (designated PT. 2) on the uphill side of the housing. As can be seen in FIG. 9B, the rod is fixed within the slot for alignment but is not vertically supported by the bottom of the slot.

Figure 10A:
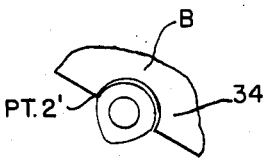
FIG. 10A is a side elevation view illustrating the position of the alignment rod within the main bearing housing for an engine block fixtured within the sled of FIGS. 2 and 3 without the main bearing cap in place.
Figure 10B:
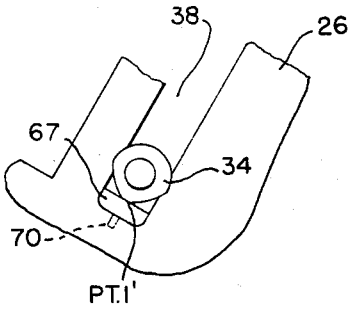
FIG. 10B is a side elevation view illustrating the position of the alignment bar within the alignment slot corresponding to its position in FIG. 10A.

When the block is fixtured with its main bearing cap off, the alignment rod can no longer use the bottom of the main bearing housing as an indexing point. In this instance, spacer blocks 67, such as the one illustrated in FIG. 2, are placed in the bottom of each alignment slot. A pin 70 depends from each spacer block and fits within an aperture 72 in the bottom of each slot. As seen in FIG. 10B, the bottom of the rod 34 is supported by the spacer block 67 to form an index point designated PT. 1'. The uphill side of the rod will contact the main bearing housing at a second point, designated PT. 2', as shown in FIG. 10A.

PNEUMATIC FLOAT SYSTEM

The preferred embodiment illustrated in FIGS. 1–3 illustrates an air float system to facilitate sliding the sled along the base of the boring machine. The air float system directs pressurized air from an air supply to either of two sets of air jet outlets 80, 82 positioned on the sled bottom 20 and alternate support surfaces 24, respectively. As illustrated schematically in FIG. 4, an activating button 162 opens an inlet valve 154 to allow pressurized air to travel to the air jet outlets 80, 82. A toggle valve 153 is actuated by a lever 164 to allow the operator of the sled to alternately direct the pressurized air to the air jet outlets of either the bottom of the sled or the alternate support surfaces.

When the inlet valve is open, pressurized air is directed not only to the air jet outlets, but to a pair of pneumatic cylinders 150 as well. These cylinders are connected to respective fingers 160 which pivot adjacent the alignment slot when activated. The fingers are positioned such that they will contact the alignment rod when it is in place within the alignment slot. When the pneumatic system is actuated after the alignment rod is in place, the fingers will push downwardly on the alignment rod to ensure that it is lowered completely into place. The cylinder and finger combination thereby ensure that proper indexing points are established as illustrated in FIGS. 9A, 9B, 10A, and 10B.

The air float system includes a pressure regulator 156 in line between the inlet valve and the air jet outlets to ensure that there is sufficient air directed toward the cylinders to enable them to operate. A needle valve assembly 152 is preferably included between the inlet valve and each cylinder, as shown in FIG. 4.

When the air float system is actuated by depressing the button 162, a cushion of air will be created between the sled and the lower slide surfaces 18 of the base assembly. This air cushion allows the operator of the sled to more easily maneuver the sled, which might otherwise be cumbersome when an engine block is mounted thereon. The sled is preferably maneuvered using either the bracket handles 30 or the button-toggle valve housing 166 which extend outwardly from the mounting surface.

The lower slide surfaces 18 preferably include a bleeder slot 19 therein as illustrated in FIG. 1. These bleeder slots are positioned near the forward end of the lower slide surfaces. If the sled is pulled forwardly on the slide surfaces that that it is over the bleeder slots, pressurized air from the air outlet jets will be exhausted through the bleeder slots, thereby destroying the cushion between the sled and the slide surfaces. The bleeder slots thus act as a safety feature to prevent the operator from inadvertently pulling the sled off the lower slide surfaces.

ALTERNATE PREFERRED EMBODIMENTS

Figure 6:
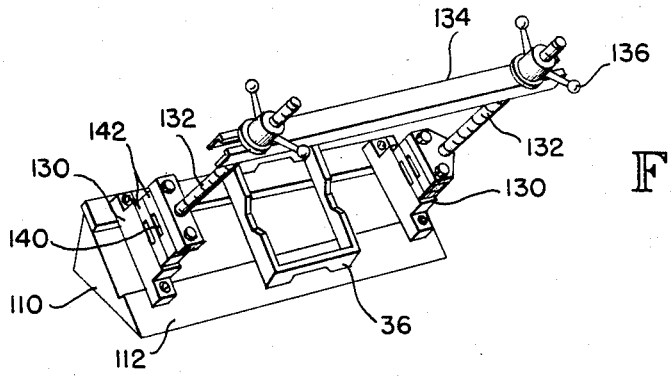
FIG. 6 is an isometric view of a second preferred embodiment of the invention.

A second preferred embodiment of the invention is illustrated in FIGS. 6 and 7. A sled 110 includes a bottom 120 and a pair of extensions 122 which depend therefrom to form a pair of alternate support surfaces 124 similar to those shown in the first embodiment. The sled includes an inclined mounting surface 112 and may be used with a frame 36, as is shown in FIG. 6.

An engine block is secured and aligned on the sled using a variation of the conventional alignment method. A pair of brackets 130 project outwardly from either side of the mounting surface, as seen in FIG. 6. Threaded columns 132 extend upwardly from the brackets to receive a mounting bar 134 which is held in place by a pair of wing nuts 136. In operation, an engine block is placed on the mounting surface or the frame (if a frame is employed). The mounting bar is then placed over the threaded columns and tightened into contact with the top of the engine block to hold it in place. A rectangular alignment bar (not shown) is inserted through correspondingly shaped openings 140 in the brackets and through the main bearing housing of the block to align the block properly on the sled. The brackets are preferably formed by at least two C-shaped members 142 which are stacked atop one another to form rectangular openings to receive the alignment bar. As illustrated in FIG. 7, these brackets may be reversed to vary the position of the openings to accommodate varying sizes of engine blocks.

Although the invention has been described and disclosed herein with respect to particular embodiments, it is not intended that the invention be limited to these embodiments but rather that it include all embodiments within the spirit of the invention.

We claim:

1. An apparatus for fixturing an engine block having inclined cylinders, such as a V-block or a Y-block, such that the cylinders are properly aligned with respect to a boring machine or the like, which comprises:

a rigid sled having an upper mounting surface for supporting the bottom of the engine block;

means for aligning the block on the mounting surface;

means for securing the block to the mounting surface such that the block will remain stationary with respect to the mounting surface after alignment; and a bottom support surface on the sled beneath the mounting surface to support the sled, the bottom surface including:

a first support surface inclined with respect to the mounting surface for orienting the mounting surface at a first angle with respect to the first support surface; and a second support surface inclined with respect to the mounting surface for alternately orienting the mounting surface at a second angle with respect to the second support surface, said second angle being greater than the first angle.

2. The apparatus of claim 1 wherein the first support surface and the second support surface include slide surfaces to facilitate sliding the apparatus during aligning of the apparatus with respect to a boring machine.

3. An apparatus for fixturing an engine block having inclined cylinders, such as a V-block or a Y-block, such that the cylinders are properly aligned with respect to a boring machine or the like, which comprises:

a sled providing a mounting surface for supporting the bottom of the engine block;

aligning means for aligning the block on the mounting surface;

securing means for securing the block to the mounting surface such that the block will remain stationary with respect to the mounting surface after alignment; and a bottom surface on the sled depending from the mounting surface to support the mounting surface, the bottom surface including:

a first support surface inclined with respect to the mounting surface for supporting the mounting surface at a first angle with respect to the first support surface; and a second support surface inclined with respect to the mounting surface for alternately supporting the mounting surface at a second angle with respect to the second support surface; and a sled for supporting a V-block with the main bearing cap in place, the elevating frame including two sets of opposed side members interconnected to form a rectangular frame, the first set of opposed side members being spaced apart a first distance and having a top surface including a cutaway portion to allow an alignment rod to pass therethrough, the second set of opposed side members being spaced apart a second distance and having a bottom surface including a cutaway portion for allowing an alignment rod to pass therethrough, the elevating frame additionally including means for releasably securing either the top or the bottom of the frame to the mounting surface of the sled, thereby providing means for elevating a block at two separate spacings along the block.

4. The apparatus of claim 1, additionally including air float means on the first support surface and the second support surface for providing a cushion of air beneath either of the support surfaces to facilitate moving the sled with respect to the boring machine or the like.

5. An apparatus for fixturing an engine block having inclined cylinders, such as a V-block or a Y-block, such that the cylinders are properly aligned with respect to a boring machine or the like, which comprises:

a sled having an upper mounting surface for supporting the bottom of an engine block, said sled also having a first bottom support surface inclined with respect to the mounting surface for supporting the sled and orienting the mounting surface at a first angle with respect to the first support surface and a second bottom support surface inclined with respect to the mounting surface for alternately supporting the mounting surface at a second angle with respect to the second support surface, said second angle being different than the first angle;

a pair of alignment brackets on the sled which project outwardly from the mounting surface, the alignment brackets being spaced apart, each alignment bracket including a slot extending inwardly from the outer portion of the bracket toward the mounting surface; and an alignment rod having a central portion sized to fit within the main bearing housing of an engine block and having two cutaway portions spaced apart corresponding to the spacing of the alignment brackets, the cutaway portion sized to fit with the slots for securing the block in place.

6. The apparatus of claim 5, further including a sling for rotatably engaging an engine block, the sling comprising an upper support member and a pair of opposing cam ears depending therefrom, the cam ears sized to fit with the cam opening of an engine block.

7. The apparatus of claim 5, further including a sling for rotatably engaging an engine block, the sling comprising:

an elongated channel member;

a pair of sling arms depending from the channel member, the sling arms including a main body portion;

means for adjusting the position of the sling arms at a plurality of spaced-apart locations along the longitudinal axis of the channel member; and a cam ear projecting from each sling arm toward the other sling arm from a location spaced apart from the channel member.

8. The sling of claim 7 wherein each sling arm is connected to the channel at a location offset from the main body portion of the sling arms above the cam ear.

9. The apparatus of claim 5 wherein the cross-section of the central portion of the alignment rod includes a rounded upper portion and an angular lower portion having a truncated bottom, thereby creating an indexing location along the intersections of the rounded upper portion and the angular lower portion and an indexing location at the truncated bottom.

10. The apparatus of claim 5, further including a pair of spacer blocks shaped correspondingly to the bottom of the slots, the spacer blocks fitting within the bottom of the slots for supporting the alignment rod when fixturing an engine block to be fixtured without a main bearing cap.

11. An elevating frame for removable mounting on the mounting surface of a fixturing sled to support a V-block with the main bearing cap in place, the elevating frame comprising:

two sets of opposed side members interconnected to form a rectangular frame, the first set of opposed side members being spaced apart a first distance and having a top surface including a cutaway portion to allow an alignment rod to pass therethrough, the second set of opposed side members being spaced apart a second distance and having a bottom surface including a cutaway portion for allowing an alignment rod to pass therethrough, the elevating frame additionally including means for releasably securing either the top or the bottom of the frame to the mounting surface of the sled, thereby providing means for elevating a block at two separate spacings along the block.

12. A sling for rotatably engaging an engine block, which comprises:

an elongated channel member;

a pair of sling arms depending from the channel member, the sling arms including a main body portion;

means for adjusting the position of the sling arms at a plurality of spaced-apart locations along the longitudinal axis of the channel member; and a cam each projecting from each sling arm toward the other sling arm from a location spaced apart from the channel member, each sling arm being connected to the channel at a location offset from the main body portion of the sling arms above the cam ear.

13. Apparatus according to claim 5 in which said mounting surface has a central longitudinal channel, and the alignment brackets fit into the channel.

14. Apparatus according to claim 5 in which hold-down fingers are pivotally mounted on the alignment brackets to swing between a hold-down position overlying the alignment rod and a retracted position, and means for swinging the fingers between their hold-down and retracted positions.

* * * * *

UNITED STATES PATENT OFFICE

CERTIFICATE OF CORRECTION

Patent No. 4,541,620 Dated September 17, 1985

Inventor(s) Donald B. Rottler and David Engnell

It is certified that error appears in the above-identified patent and that said Letters Patent are hereby corrected as shown below:

In the claims:

col. 11, line 11, "a cam each" should be --a cam ear--.

Signed and Sealed this

*Seventeenth* Day of *June 1986*

[SEAL]

*Attest:*

DONALD J. QUIGG

*Attesting Officer*

*Commissioner of Patents and Trademarks*